US011642260B2

(12) United States Patent
Thodupunuri et al.

(10) Patent No.: US 11,642,260 B2
(45) Date of Patent: May 9, 2023

(54) VARIABLE WIDTH HOSPITAL BED

(71) Applicant: Hill-Rom Services, Inc., Batesville, IN (US)

(72) Inventors: Mahesh Kumar Thodupunuri, Batesville, IN (US); Jeffrey A. Ruschke, Lawrenceburg, IN (US); Victor Potter, Middletown, OH (US); David P. Lubbers, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 314 days.

(21) Appl. No.: 13/963,245

(22) Filed: Aug. 9, 2013

(65) Prior Publication Data

US 2014/0047641 A1 Feb. 20, 2014

Related U.S. Application Data

(60) Provisional application No. 61/684,275, filed on Aug. 17, 2012.

(51) Int. Cl.
*A61G 7/16* (2006.01)
*A61G 7/002* (2006.01)
(Continued)

(52) U.S. Cl.
CPC ..... *A61G 7/015* (2013.01); *A61G 7/002* (2013.01); *A61G 7/018* (2013.01); *A61G 7/0514* (2016.11); *A61G 7/0524* (2016.11); *A61G 7/05769* (2013.01); *A61G 2200/16* (2013.01); *A61G 2203/20* (2013.01); *A61G 2203/30* (2013.01); *A61G 2203/34* (2013.01); *F04C 2270/041* (2013.01)

(58) Field of Classification Search
CPC ..... A61G 7/0507; A61G 7/002; A61G 7/015; A61G 7/16; A61G 2203/40; A61G 2203/36; A61G 2203/12
USPC ..... 5/11, 600, 611, 610, 618
See application file for complete search history.

(56) References Cited

U.S. PATENT DOCUMENTS 6,212,714 B1 * 4/2001 Allen et al. ..... 5/624
6,357,065 B1 * 3/2002 Adams ..... 5/618
(Continued)

FOREIGN PATENT DOCUMENTS

WO 2013131078 A1 9/2013

OTHER PUBLICATIONS

European Search Report Response for EP Application 13180474.2, Aug. 18, 2014.

(Continued)

*Primary Examiner* — Robert G Santos
*Assistant Examiner* — Ifeolu A Adeboyejo
(74) *Attorney, Agent, or Firm* — Barnes & Thornburg LLP

(57) ABSTRACT

A system for changing width of a person support apparatus is disclosed. A person support apparatus comprises at least one deck extension which is configured to be retracted or extended by at least one motor controlled by a bed controller. A mattress controller communicates with a bed controller and controls a fluid supply device to inflate or deflate a mattress supported by the person support apparatus to alter the width of the mattress. The mattress may also be inflated or deflated in response to manual extension or retraction of the deck extension.

19 Claims, 11 Drawing Sheets

(51) Int. Cl.

| | |
|---|---|
| ***A61G 7/015*** | (2006.01) |
| ***A61G 7/018*** | (2006.01) |
| ***A61G 7/05*** | (2006.01) |
| *A61G 7/057* | (2006.01) |

(56) References Cited

U.S. PATENT DOCUMENTS

| | | | | |
|---|---|---|---|---|
| 7,363,663 | B2 | 4/2008 | Chambers et al. | |
| 7,565,710 | B2 | 7/2009 | Chambers et al. | |
| 7,971,300 | B2 * | 7/2011 | Wilker, Jr. | 5/713 |
| RE43,155 | E * | 2/2012 | Allen et al. | 5/618 |
| 8,122,546 | B2 | 2/2012 | Chambers et al. | |
| 2006/0021142 | A1 | 2/2006 | Hornbach et al. | |
| 2006/0026762 | A1 | 2/2006 | Hornbach et al. | |
| 2006/0026767 | A1 * | 2/2006 | Chambers et al. | 5/713 |
| 2006/0059624 | A1 * | 3/2006 | Poulos et al. | 5/618 |
| 2006/0101580 | A1 | 5/2006 | Biggie et al. | |
| 2008/0172789 | A1 * | 7/2008 | Elliot et al. | 5/616 |
| 2009/0237264 | A1 * | 9/2009 | Bobey et al. | 340/815.69 |
| 2011/0047709 | A1 | 3/2011 | Tarsaud et al. | |
| 2011/0072583 | A1 * | 3/2011 | McNeely et al. | 5/616 |
| 2011/0113561 | A1 * | 5/2011 | Douglas | 5/713 |
| 2012/0047647 | A1 * | 3/2012 | Steers | A47C 27/082 5/13 |
| 2012/0317727 | A1 * | 12/2012 | Tanaka et al. | 5/710 |

OTHER PUBLICATIONS

Pages 1 and 1a for EP Application 13180474.2.
Annotated Pages for EP Application 13180474.2.
Claims for EP Application 13180474.2.
Annotated claims for EP Application 13180474.2.
U.S. Appl. No. 13/468,424; Bed With A Powered Width Expansion Wing; filed May 10, 2012; Bossingham et al.
U.S. Appl. No. 61/760,881; Bed With A Width Expansion Wing; filed Jan. 30, 2013; Lattimore.
U.S. Appl. No. 61/763,470; Bed With A Powered Width Expansion Wing With Manual Release; filed Feb. 11, 2013; Rigsby.
U.S. Appl. No. 61/788,210; Bed With A Powered Width Expansion Wing With Manual Release: filed Mar. 15, 2013; Rigsby et al.
Extended EP Search Report for Application 13180474.2; Place of Search—The Hague; Date of Completion of the Search—Dec. 12, 2013.
Extended EP Search Report for European Patent Application No. 18173689.3 dated Aug. 23, 2018; 7 pages.

* cited by examiner

VARIABLE WIDTH HOSPITAL BED

BACKGROUND

Accommodation of patients of a wide girth on a patient support apparatus is an ongoing challenge. Transport of a patient support apparatus designed to accommodate patients of a wide girth through doorways not sized for transport of such apparatus is a continuing concern. While several systems and methods have been developed to provide the ability to change the width of a patient support apparatus, an opportunity exists for continued development in this area.

BRIEF SUMMARY

The present disclosure includes one or more of the features recited in the appended claims and/or the following features which, alone or in any combination, may comprise patentable subject matter.

One embodiment of a system for changing width of a person support apparatus may comprise a control interface comprising a button for width alteration of the person support apparatus. A bed controller may be configured to communicate with the control interface the bed controller may be configured to receive a signal if the button is selected. A motor may be configured to be controlled by the bed controller the motor may be configured to alter the width of at least a portion of a deck section of the person support apparatus. A mattress controller may be configured to communicate with the bed controller. A fluid supply device may be configured to be controlled by the mattress controller. A mattress may be configured to be supported the person support apparatus, the mattress may comprise at least one chamber fluidly connected to the fluid supply device and may be configured to be inflated by the fluid supply device upon the fluid supply device receiving a control signal from the mattress controller.

One embodiment of a method for changing width of a person support apparatus may comprise monitoring a button for width alteration of the person support apparatus on a control interface. Sensing selection of the button by a bed controller. Sending at least one of inflate or deflate command to a mattress controller based on configuration of at least one deck section of the person support apparatus. Determining completion of at least one of inflation and deflation of a mattress and sending an indication to the bed controller of completion. Actuating at least one deck section to at least one of an extended and retracted position upon the bed controller sending a command to a motor.

Another embodiment of a method for changing width of a person support apparatus comprises determining position of at least one deck section of a person support apparatus. Monitoring a button on a control interface for width alteration of said person support apparatus. Controlling a fluid supply device to at least one of inflate and deflate a mattress in fluidic communication with said fluid supply device based on selection of said button.

BRIEF DESCRIPTION OF DRAWINGS

The accompanying drawings incorporated in and forming a part of the specification illustrate several aspects of the claimed subject matter and, together with the description, serve to explain the principles of the claimed subject matter. In the drawings:

DETAILED DESCRIPTION OF ILLUSTRATIVE EMBODIMENTS

Figure 1:
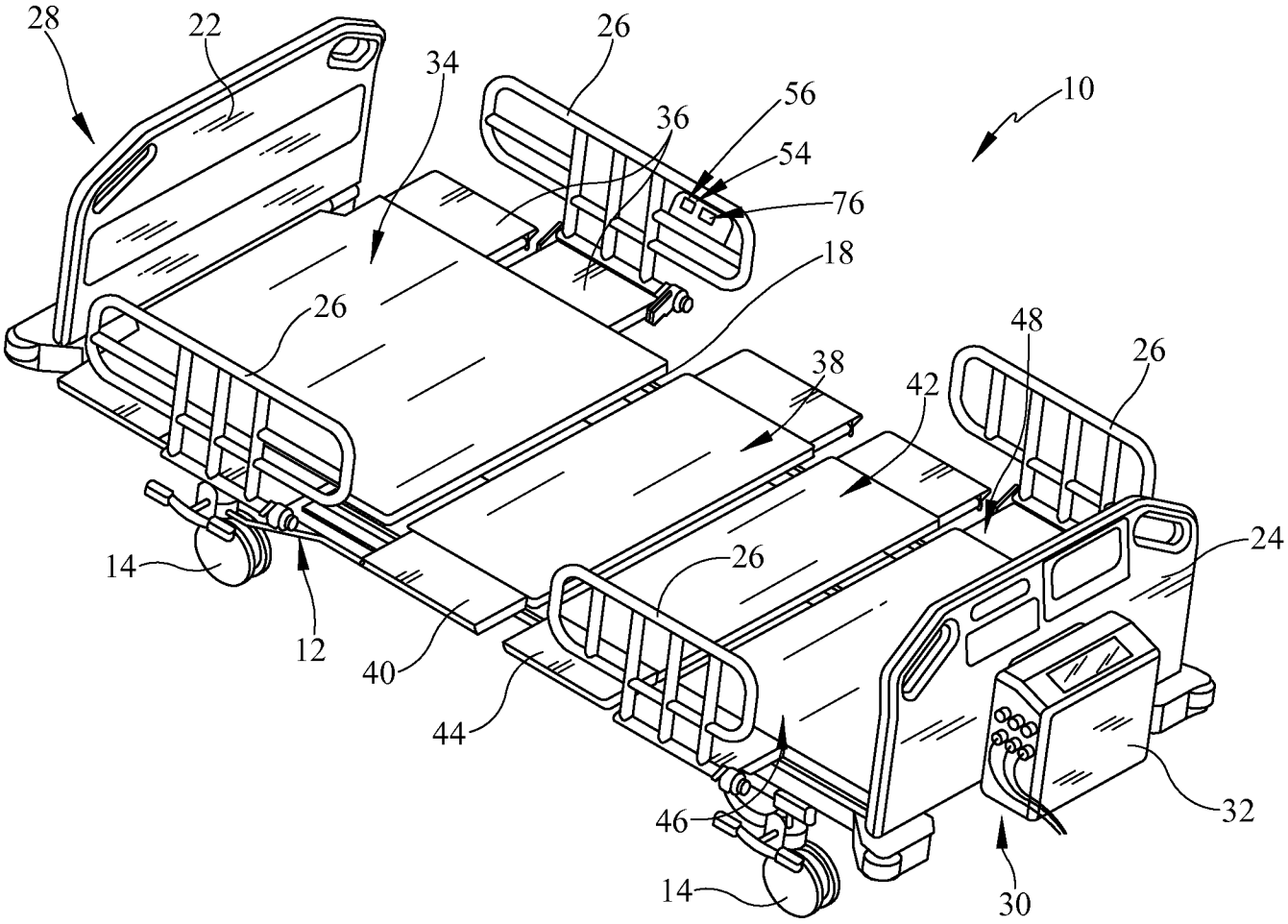
FIG. 1 is a perspective view of a changeable width person support apparatus, constructed according to one or more of the principles disclosed herein.

The embodiments of the claimed subject matter and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be briefly mentioned or omitted so as to not unnecessarily obscure the embodiments of the claimed subject matter described. The examples used herein are intended merely to facilitate an understanding of ways in which the claimed subject matter may be practiced and to further enable those of skill in the art to practice the embodiments of the claimed subject matter described herein. Accordingly, the examples and embodiments herein are merely illustrative and should not be construed as limiting the scope of the claimed subject matter, which is defined solely by the appended claims and applicable law. Moreover, it is noted that like reference numerals represent similar parts throughout the several views of the drawings.

It is understood that the subject matter claimed is not limited to the particular methodology, protocols, devices, apparatus, materials, applications, etc., described herein, as these may vary. It is also to be understood that the terminology used herein is used for the purpose of describing particular embodiments only, and is not intended to limit the scope of the claimed subject matter.

Unless defined otherwise, all technical and scientific terms used herein have the same meanings as commonly understood by one of ordinary skill in the art.

The claimed subject matter discloses a variable width person support apparatus which is configured to support a mattress thereon. A system to inflate or deflate portions of the mattress to accommodate a wider or narrower deck section of the person support apparatus is disclosed herein.

FIG. 1 shows a variable width person support apparatus 10, in this embodiment the person support apparatus 10 is a bed however, in other embodiments the person support apparatus 10 may be a wheelchair, stretcher or any other apparatus configured to support a person thereon. The person support apparatus 10 in this embodiment comprises an upper frame 18 which is supported over a lower frame 12 by supports. The supports are configured to variably elevate at least a portion of the upper frame 18 with respect to the lower frame 12. The lower frame 12 rests on at least one caster wheel 18 in this embodiment, allowing the person supported apparatus 10 to be transported. The person support apparatus 10 in this embodiment comprises a head board 22 at the head end 28 and a foot board 24 at the foot end 30. The upper frame 18 supports an upper body deck section 34, seat deck section 38, thigh deck section 42 and foot deck section 46. The upper body deck section 34, seat deck section 38, thigh deck section 42 and foot deck section 46 are configured to increase in width by articulation of upper body deck extension 36 (also referred to as extender 36), seat deck section extension 40, thigh deck section extension 44 and foot deck section extension 48. One or more deck extension comprises siderails 26 which define the lateral extremity of the person support apparatus 10. A fluid supply device 32 is configured to supply fluid to a mattress 16 (shown in FIG. 2) and is removably mounted on the foot board 24 in this embodiment while in other embodiments the fluid supply device 32 may be mounted anywhere on the person support apparatus 10. A control interface 54 is removably mounted on the siderail 26 as shown in FIG. 1. The control interface 54 comprises a display 76 which is configured to display alerts and visual messages to a viewer and at least one button 56 to control the extension and retraction of at least one deck extension. The display 76 in one embodiment is a Liquid Crystal Display (LCD) screen although any other technology could is used in other embodiments. The button 56 is a physical push button while in another embodiment the display 76 is a touch sensitive screen and button 56 is displayed on the touch sensitive screen. The control interface 54 may employ one button 56 for commanding both extension and retraction while in other embodiments the control interface 54 may comprise one button for commanding extension and a separate button for commanding retraction.

Figure 2:
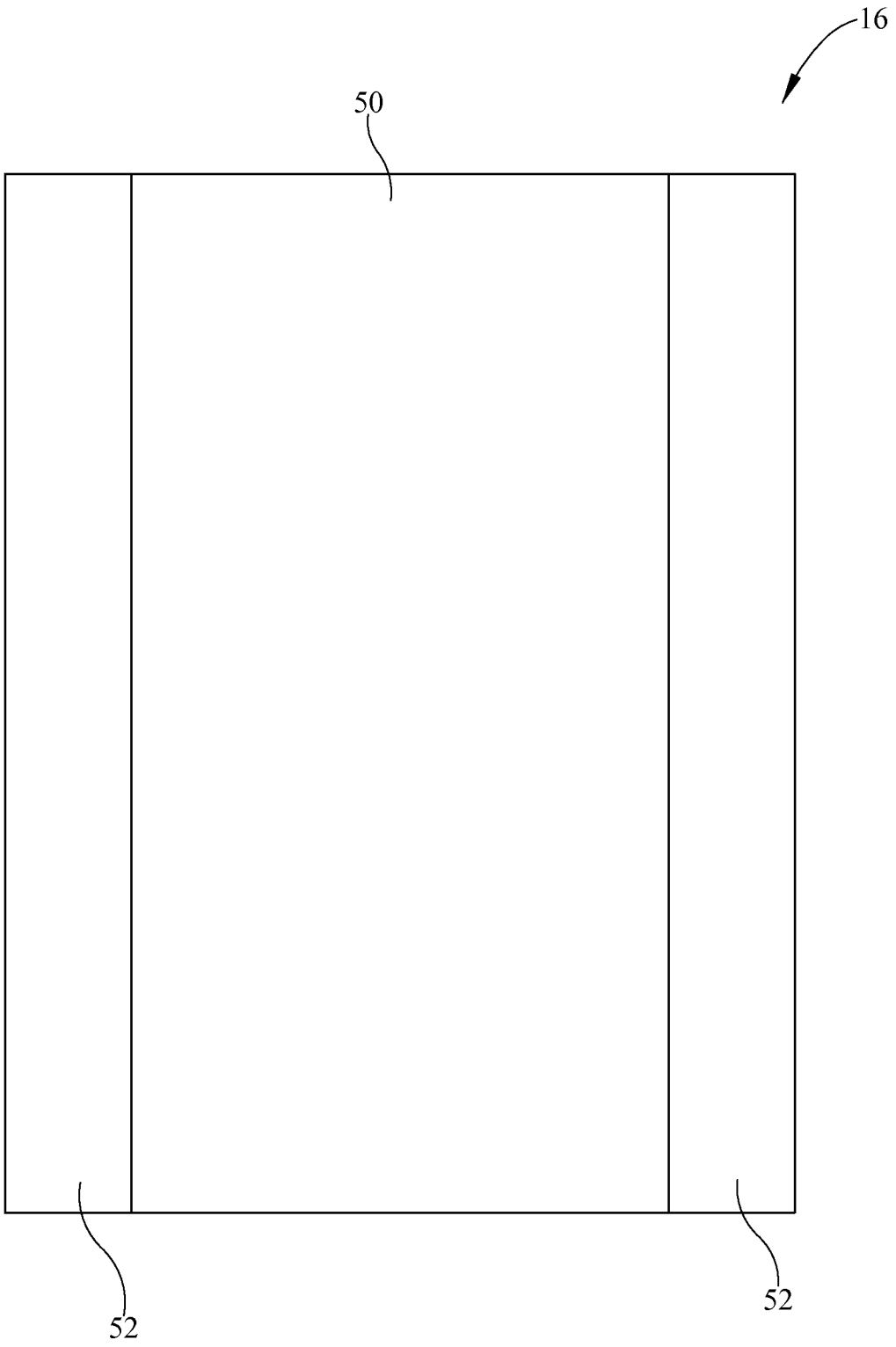
FIG. 2 is a schematic plan view of a mattress configured to be used with changeable width person support apparatus, constructed according to one or more of the principles disclosed herein.

FIG. 2 shows a mattress 16 configured to rest on the person support apparatus 10 shown in FIG. 1. As shown in this embodiment the mattress 16 comprises a mattress core 50 and mattress side bolsters 52 on either side of the mattress core 50. The mattress side bolsters 52 comprise at least one chamber configured to be supplied with fluid by the fluid supply device 32 thereby inflating the mattress side bolsters 52 in one embodiment. In another embodiment the fluid supply device 32 controls both inflation and deflation of the mattress side bolsters 52. In this embodiment the mattress core is also made up of at least one bladder configured to be filled by fluid supplied by fluid supply device 32. In another embodiment the mattress core 50 comprises foam. In yet another embodiment the mattress 16 may be made of any combination of bladders, foam, textile and other polymeric materials. The mattress side bolsters 52 are inflated or deflated based on whether the deck extensions are extended or retracted.

U.S. patent application Ser. Nos. 11/774,847, 11/775,083 and 13/468,424 disclosing variable width person support apparatus, related systems and methods of use are hereby expressly incorporated herein by reference.

Figure 3:
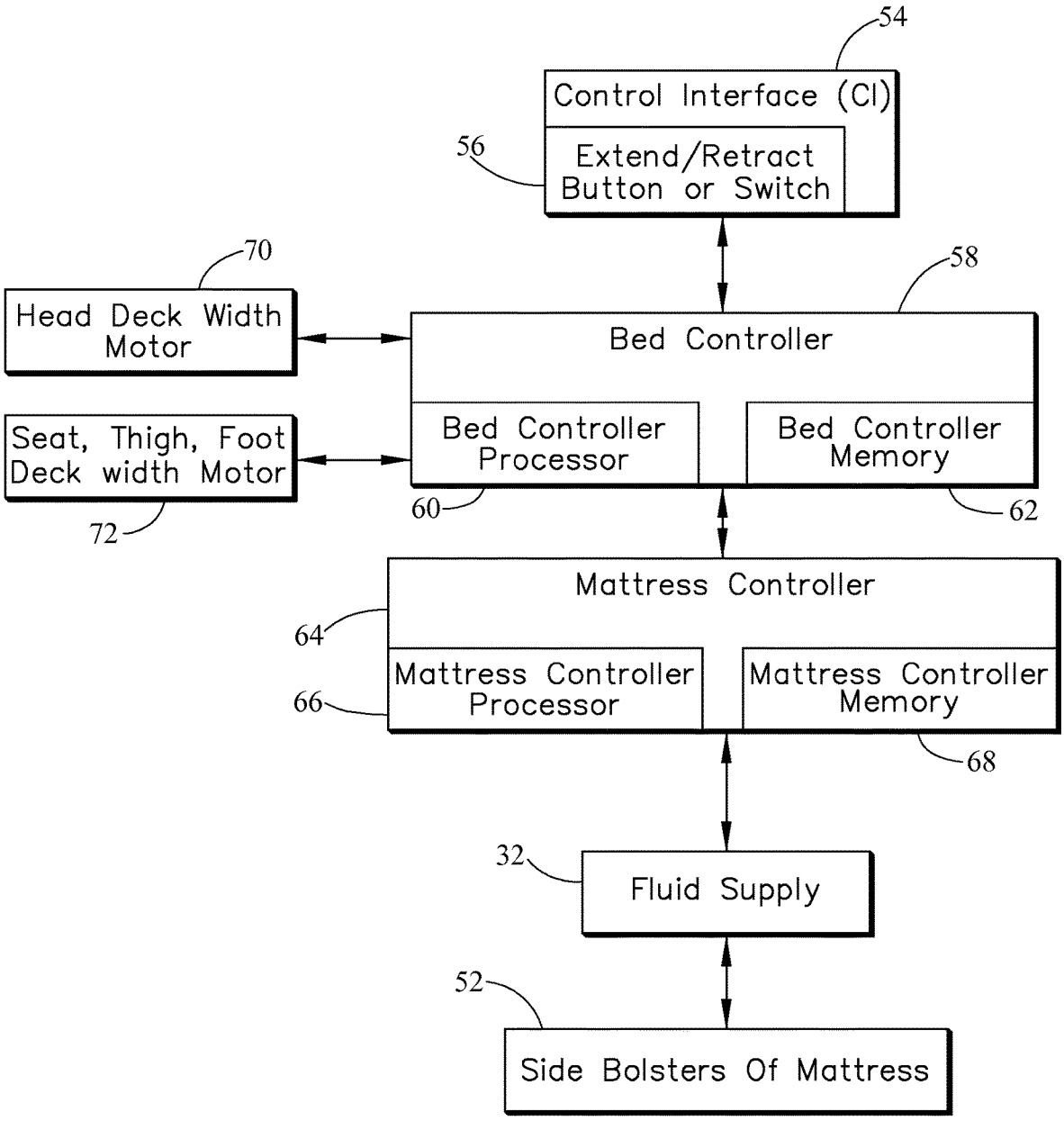
FIG. 3 is a block diagram of one embodiment of a system configured to change width of a person support apparatus, constructed according to one or more of the principles disclosed herein.

FIG. 3 shows a block diagram of one embodiment of a system configured to change width of a person support apparatus 10. Control interface 54 comprises a button 56 to allow a user to extend or retract at least one deck extension. A bed controller 58 comprises a bed controller processor 60 and a bed controller memory 62. The control interface 54 is in communication with a bed controller processor 60 which is configured to receive a command signal indicative of selection of the button 56. Alternatively, the command signal may be generated in response to manual operation to alter the width of a deck section, for example by a person pushing or pulling on the deck section (or a component such as a siderail which is attached to the deck section) to retract or extend it manually. In this embodiment the bed controller memory 62 is configured to store information regarding the position of at least one of the deck sections including whether they are in the fully extended or fully retracted positions. In this embodiment a head deck width motor 70 actuates the upper body deck extension 36 while a lower body deck width motor 72 actuates the seat deck section extension 40, thigh deck section extension 44 and foot deck section extension 48 respectively. In yet another embodiment each of the seat deck section extension 40, thigh deck section extension 44 and foot deck section extension 48 are actuated independently by their own motors which are in communication with the bed controller 58. The bed controller 58 is configured to track position of the upper body deck extension 36 based on current feedback from the head deck width motor 70. In this embodiment when the upper body deck section 36 is fully retracted or extended it hits a mechanical stop and/or feature which causes a surge in current which is recorded by the bed controller 58 and used to determine the event of complete extension or retraction being reached. The bed controller 58 communicates similarly with the lower body deck width motor 72. The bed controller 58 in this embodiment is mounted on the lower frame 12 while in other embodiments the bed controller 58 may be mounted anywhere on the person support apparatus 10. The bed controller 58 is configured to communicate with a mattress controller 64 comprising a mattress controller processor 66 and a mattress controller memory 68. The mattress controller 64 is configured to communicate with a fluid supply device 32. In this embodiment the fluid supply device 32 is a blower while in other embodiments the fluid supply device 32 may be a compressor or a pump. The mattress controller processor 66 is configured to control the fluid supply device 32 to inflate or deflate side bolsters 52.

Continuing to refer to FIG. 3 the signal between the control interface and the bed controller is referred to as a command signal. However as described above a user may retract or extend the deck extensions manually in which case the command signal is generated in response to the manual operation. The signal between the bed controller and the mattress controller is referred to as a mattress control signal. The signal between the mattress controller and the fluid supply device is referred to as a fluid supply control signal. The signal between the bed controller and the motor is referred to as a motor control signal.

Figure 4:
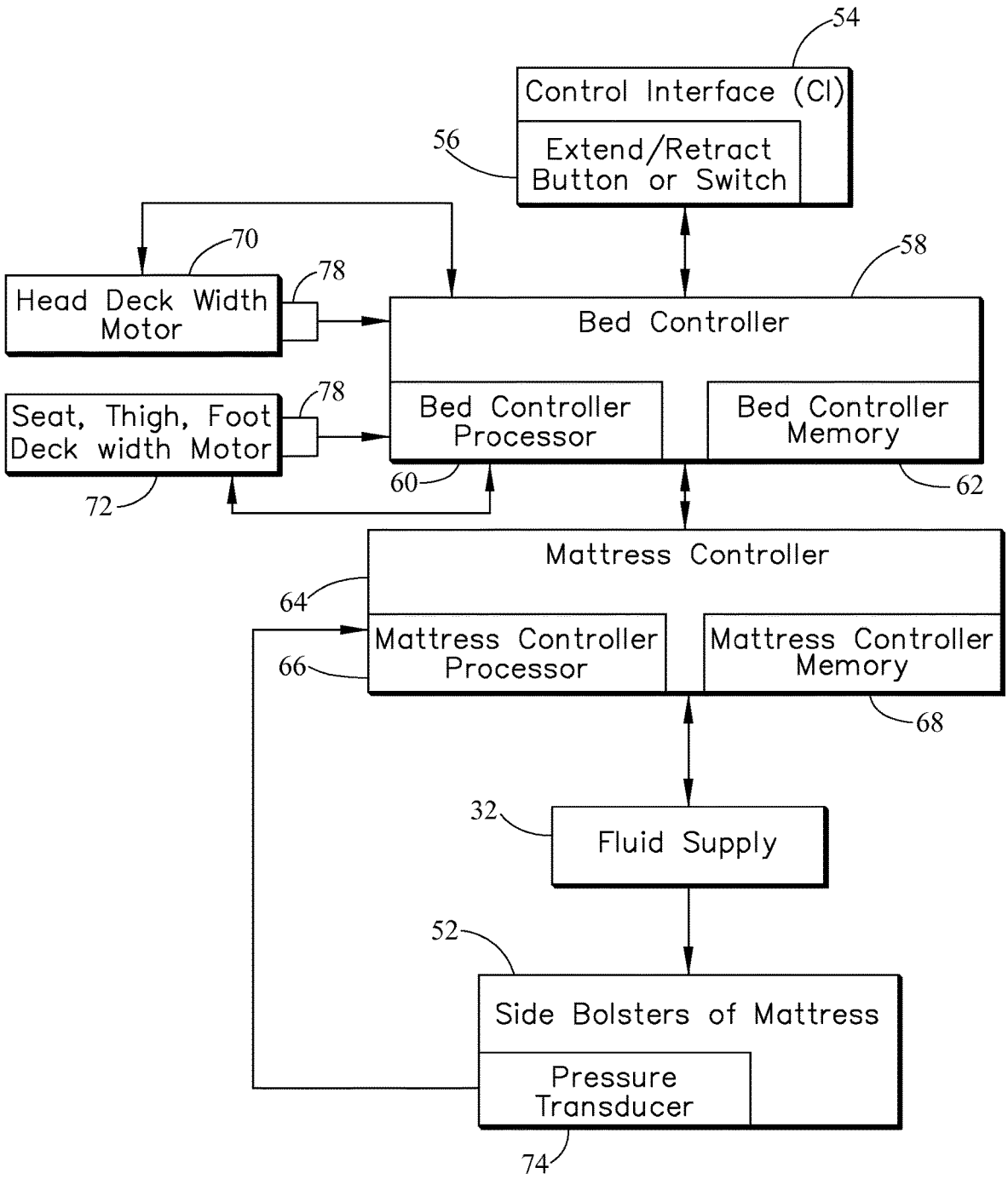
FIG. 4 is a block diagram of another embodiment of a system configured to change width of a person support apparatus, constructed according to one or more of the principles disclosed herein.

FIG. 4 shows a block diagram of another embodiment of a system configured to change width of a person support apparatus 10. Control interface 54 comprises a button 56 to allow a user to extend or retract at least one deck extension. A bed controller 58 comprises a bed controller processor 60 and a bed controller memory 62. The control interface 54 is in communication with a bed controller processor 60 which is configured to receive a signal indicative of selection of the button 56. In this embodiment the bed controller memory 62 is configured to store information regarding the position of at least one of the deck sections including whether they are in the fully extended or fully retracted positions. In this embodiment the head deck width motor 70 actuates the upper body deck extension 36 while a lower body deck width motor 72 actuates the seat deck section extension 40, thigh deck section extension 44 and foot deck section extension 48 respectively. In yet another embodiment each of the seat deck section extension 40, thigh deck section extension 44 and foot deck section extension 48 are actuated independently by their own motors which are in communication with the bed controller 58. The bed controller 58 is configured to track position of the upper body deck extension 36 based on communication received from potentiometers 78. Potentiometers 78 are mounted on the motor shafts in one embodiment while in another embodiment the potentiometers 78 may be mounted anywhere on the person support apparatus and configured to sense motion of deck extensions. As the deck sections extend or retract, signals sent by potentiometers 78 allow the bed controller 58 to track position of the deck extensions. The bed controller 58 in this embodiment is mounted on the lower frame 12 while in other embodiments the bed controller 58 may be mounted anywhere on the person support apparatus 10. Bed controller memory 62 is configured to store information representative of the signal supplied by the potentiometers 78 as well as thresholds values of position which would indicate full extension or retraction of the deck extensions. The bed controller 58 is configured to communicate with a mattress controller 64 comprising a mattress controller processor 66 and a mattress controller memory 68. The mattress controller 64 is configured to communicate with a fluid supply device 32. In this embodiment the fluid supply device 32 is a blower while in other embodiments the fluid supply device 32 may be a compressor or a pump. The mattress controller processor 66 is configured to control the fluid supply device 32 to inflate or deflate side bolsters 52. In this embodiment the mattress side bolsters 52 comprise at least one pressure transducer 74 which is configured to communicate with mattress controller 64. Signals from the pressure transducer 74 allow the mattress controller to determine the pressure inside the side bolsters 52 which in one embodiment allows the mattress controller 64 to determine if the pressure is low enough that the side bolsters 52 are in a fully deflated state or high enough that the side bolsters 52 are fully inflated. Mattress controller memory 68 is configured to store information representative of the signal supplied by the pressure transducer 74 as well as thresholds values of pressure which would indicate full inflation or deflation of the side bolsters 52.

In one embodiment the deck extensions may be manually extended and retracted. When the deck extensions are retracted manually the side rails 26 would apply pressure on the side bolsters 52 as a user pushes the siderail 26 against the mattress 16. In one embodiment a signal from the pressure transducer 74 indicating a spike in pressure greater than a predetermined threshold in the side bolsters 52 is used to initiate deflation of the side bolsters.

Figure 5:
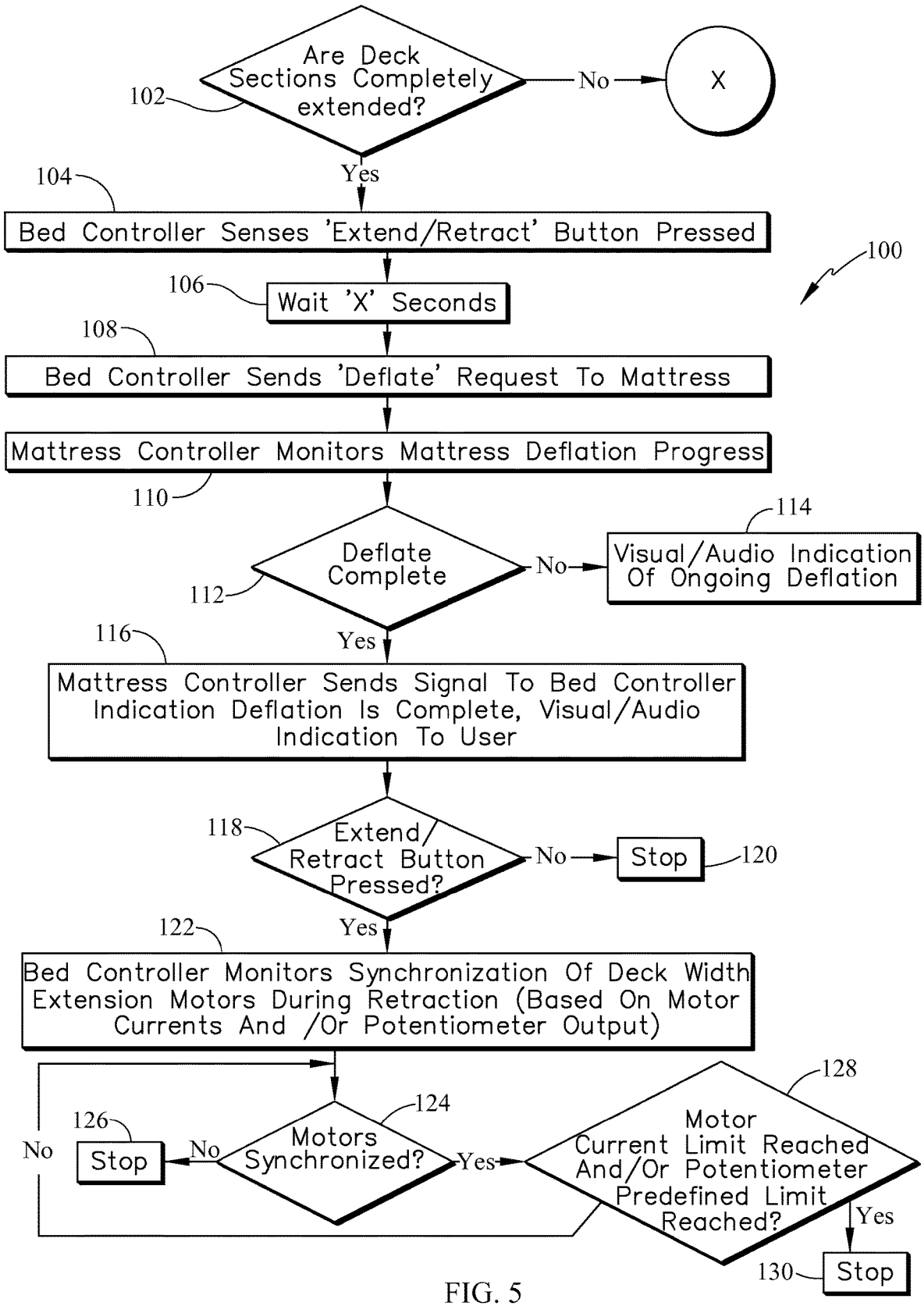
FIGS. 5-6 show a flowchart showing a first method of changing width of a person support apparatus, constructed according to one or more of the principles disclosed herein.
Figure 6:
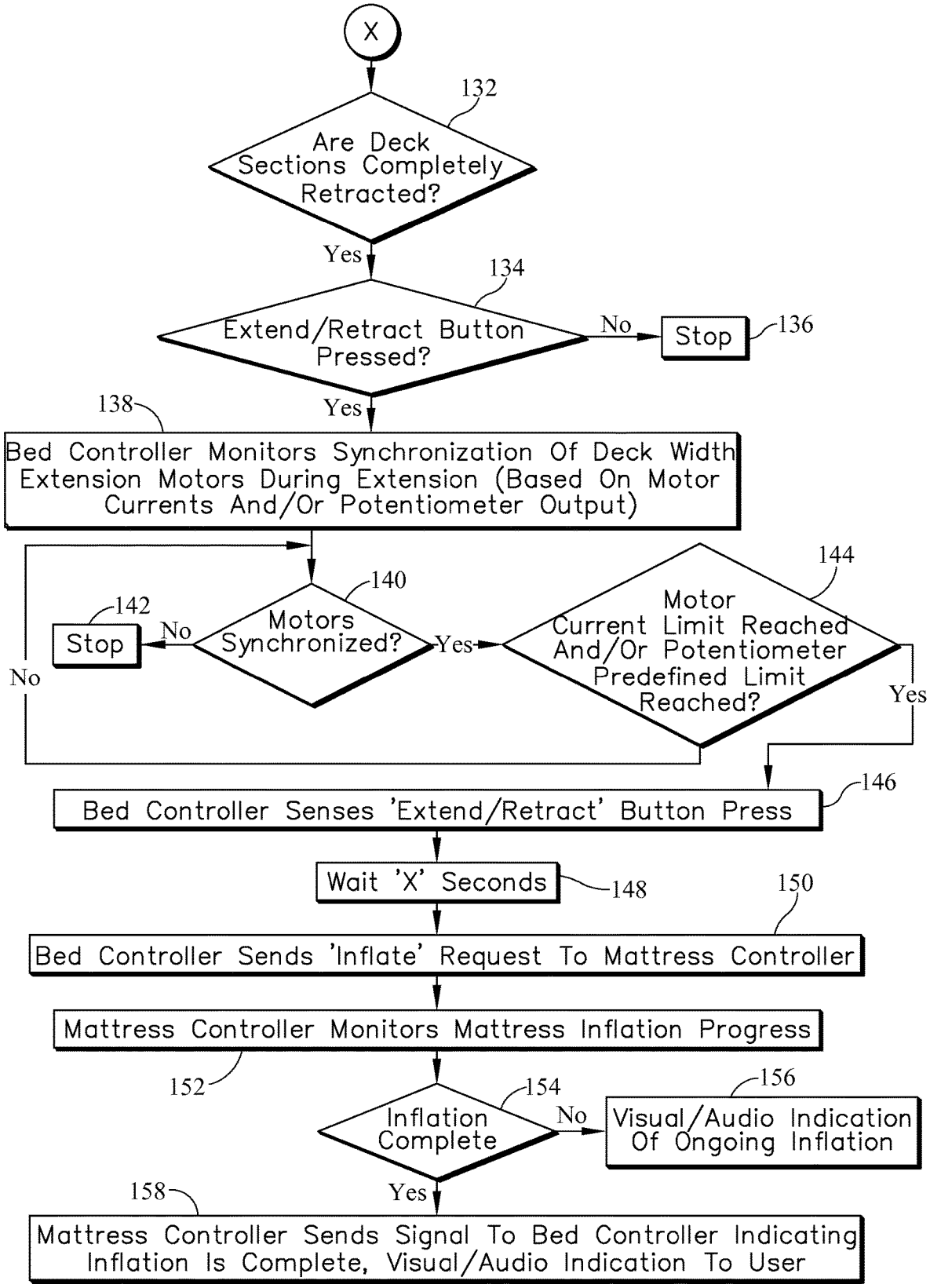

FIGS. 5-6 show a flowchart 100 showing a method of changing width of a person support apparatus 10. At operation 102, a determination is made by the bed controller 58 as to whether the deck sections are completely extended. If the deck sections are completely extended, the bed controller senses selection of the button 56 in operation 104 after which the system waits for a predetermined time, in one embodiment 2 seconds, in other embodiments, any amount of time in operation 106. The bed controller 58 sends a signal to the mattress controller 64 to deflate the mattress side bolsters 52 in operation 108. Mattress controller 64 monitors deflation of the mattress side bolsters 52 in operation 110. Mattress controller 64 determines if the mattress side bolsters 52 are completely deflated in operation 112. In one embodiment the mattress controller 64 makes this determination by comparing a pressure derived from the signal supplied by pressure transducer 74 with a predetermined threshold which in one embodiment may be defined by a user though control interface 54. In another embodiment the mattress controller 64 determines if the mattress side bolsters 52 are completely deflated by tracking the time spent deflating the mattress side bolsters 52. If the mattress controller 64 determines that the mattress side bolsters 52 are not completely deflated it sends a corresponding signal to the bed controller 58 at operation 114. The bed controller 58 sends the signal to the control interface 54 through which an audio indication and/or a visual indication on display 76 of ongoing mattress side bolster 52 deflation is communicated. If mattress controller 64 determines that deflation is complete at block 114 it communicates with the bed controller 58. The bed controller 58 sends a signal to the control interface 54 through which an audio indication and/or a visual indication on display 76 of completion of mattress side bolster 52 deflation is communicated in operation 116. The bed controller 58 now checks to determine whether button 56 is selected at operation 118. If not, the bed controller 58 communicates a signal to the control interface 54 to display a message indicating that the mattress side bolsters are deflated at step 120. If the bed controller 58 determines that the button 56 is selected, it sends a signal to head deck width motor 70 and lower body deck width motor 72 to begin retracting the deck extensions; the bed controller 58 monitors actuation of the deck extensions in operation 122. During actuation of the deck extensions the bed controller 58 determines whether the head deck width motor 70 and lower body deck width motor 72 are synchronized in operation 124. If the bed controller 58 determines that the motors are not synchronized it sends a signal to the control interface 54 to display an error message in step 126. If the bed controller 58 determines that the motors are synchronized, the bed controller 58 monitors whether the end of travel indicative of complete retraction of deck extension has been reached based on signals from the potentiometer and/or current readings from the motors in operation 128. If the bed controller 58 determines complete retraction of the deck extensions have been reached, the bed controller 58 sends a signal to the motors to stop actuation. If the bed controller 58 determines that the deck extensions have not been completely retracted, the bed controller continues to monitor whether the motors are synchronized in step 124.

If at operation 132, a determination is made by the bed controller 58 that the deck sections are completely retracted, the bed controller 58 now checks to determine whether button 56 is selected at operation 134. If not, the bed controller 58 communicates a stop signal at step 136. If the bed controller 58 determines that the button 56 is selected, it sends a signal to head deck width motor 70 and lower body deck width motor 72 to begin extending the deck extensions; the bed controller 58 monitors actuation of the deck extensions in operation 138. During actuation of the deck extensions the bed controller 58 determines whether the head deck width motor 70 and lower body deck width motor 72 are synchronized in operation 140. If the bed controller 58 determines that the motors are not synchronized it sends a signal to the control interface 54 to display an error message in step 142. If the bed controller 58 determines that the motors are synchronized, the bed controller 58 monitors whether the end of travel indicative of complete extension has been reached based on signals form the potentiometer and/or current readings from the motors in operation 144. If the bed controller 58 determines that complete extension of the deck extensions has been reached, the bed controller 58 sends a signal to the motors to stop actuation. If the bed controller 58 determines that the deck extensions have not been completely extended, the bed controller continues to monitor whether the motors are synchronized in step 140.

In operation 144 if it is determined by the bed controller 58 that the deck sections are completely extended, the bed controller senses selection of the button 56 in operation 146 after which the system waits for a predetermined time, in one embodiment 2 seconds, in other embodiments, any amount of time in operation 148. The bed controller 58 sends a signal to the mattress controller 64 to inflate the mattress side bolsters 52 in operation 150. Mattress controller 64 monitors inflation of the mattress side bolsters 52 in operation 152. Mattress controller 64 determines if the mattress side bolsters 52 are completely inflated in operation 154. In one embodiment the mattress controller 64 makes this determination by comparing a pressure derived from the signal supplied by pressure transducer 74 with a predetermined threshold which in one embodiment may be defined by a user though control interface 54. In another embodiment the mattress controller 64 determines if the mattress side bolsters 52 are completely inflated by tracking the time spent inflating the mattress side bolsters 52. In operation 154 if the mattress controller 64 determines the mattress side bolsters 52 are not completely inflated, it sends a corresponding signal to the bed controller 58. The bed controller 58 sends a signal to the control interface 54 through which an audio indication and/or a visual indication on display 76 of ongoing mattress side bolster 52 inflation is communicated in operation 156. If mattress controller 64 determines that inflation is complete it communicates with the bed controller 58. The bed controller 58 sends a signal to the control interface 54 through which an audio indication and/or a visual indication on display 76 of completion of mattress side bolster 52 inflation is communicated in operation 158.

In this embodiment the mattress side bolsters 52 are configured to toggle between a fully inflated state and a fully deflated state. In one embodiment the pressure indicative of full inflation is variable based on weight of the patient supported by the mattress to a predetermined pressure relief set point. In another embodiment the pressure indicative of full inflation may be input by a user via the control interface 54.

Figure 7:
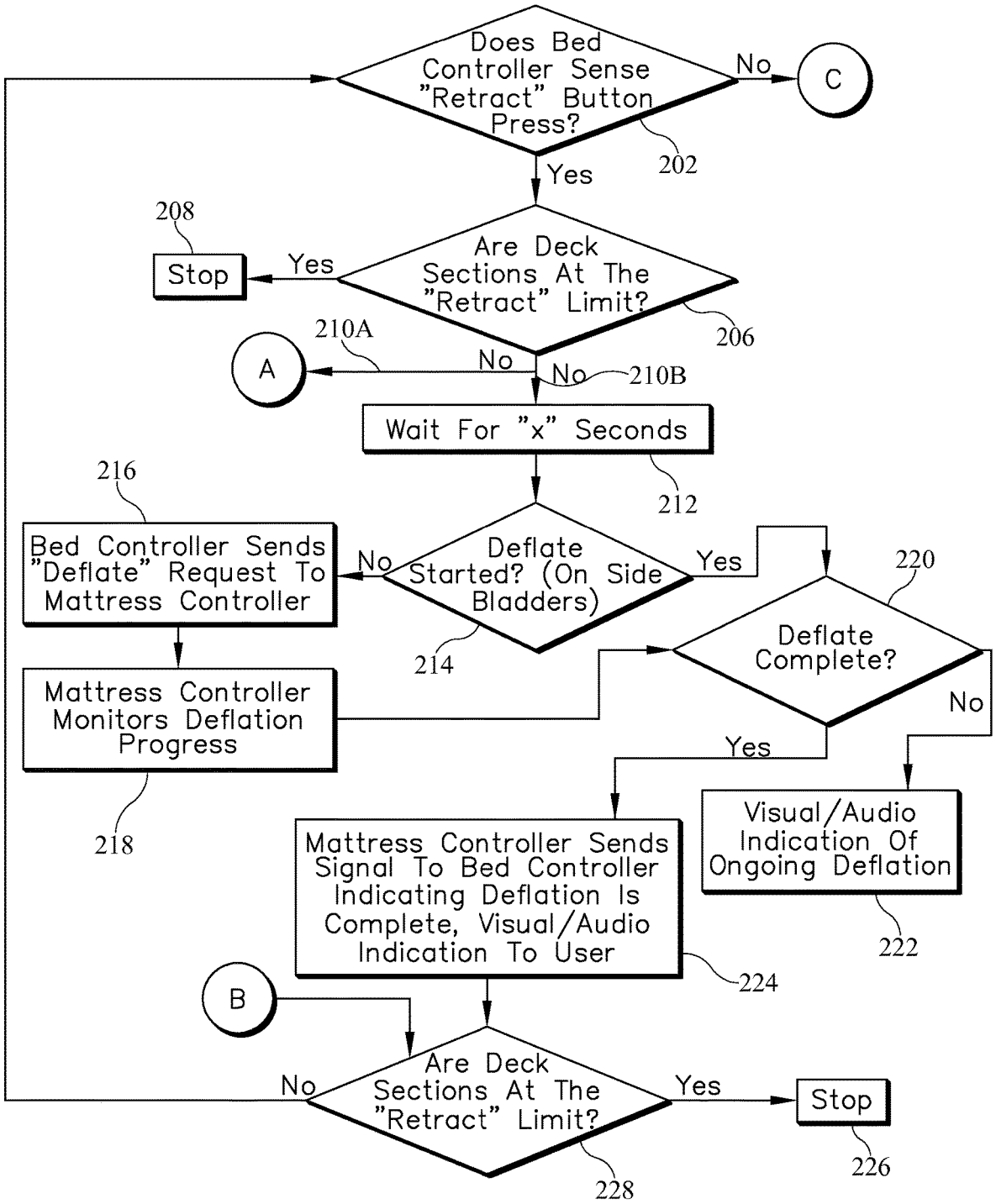
FIGS. 7, 7B, 8 and 8B are flowcharts showing a second method of changing the width of a person support apparatus.
Figure 7B:
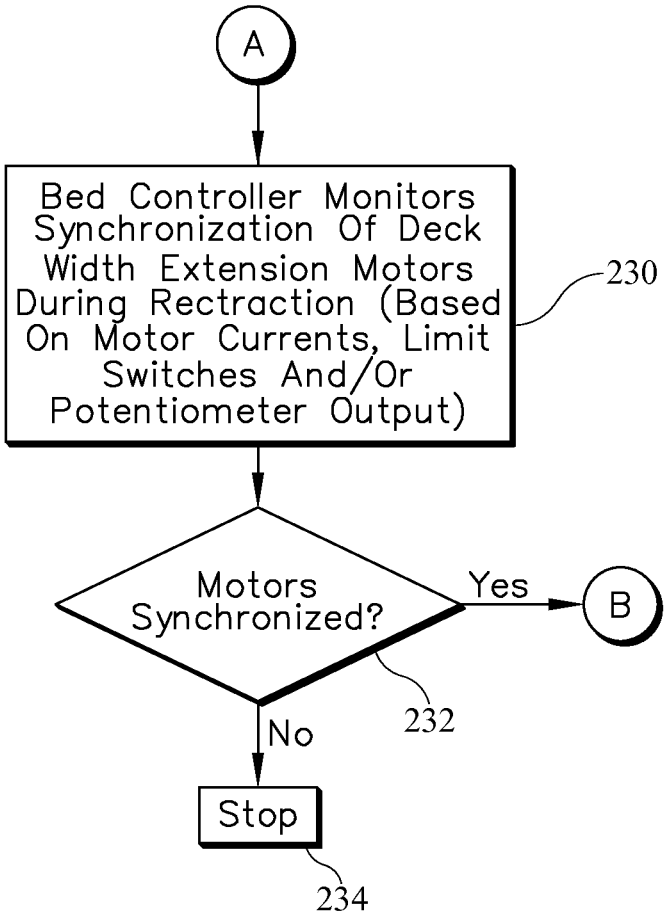
Figure 8:
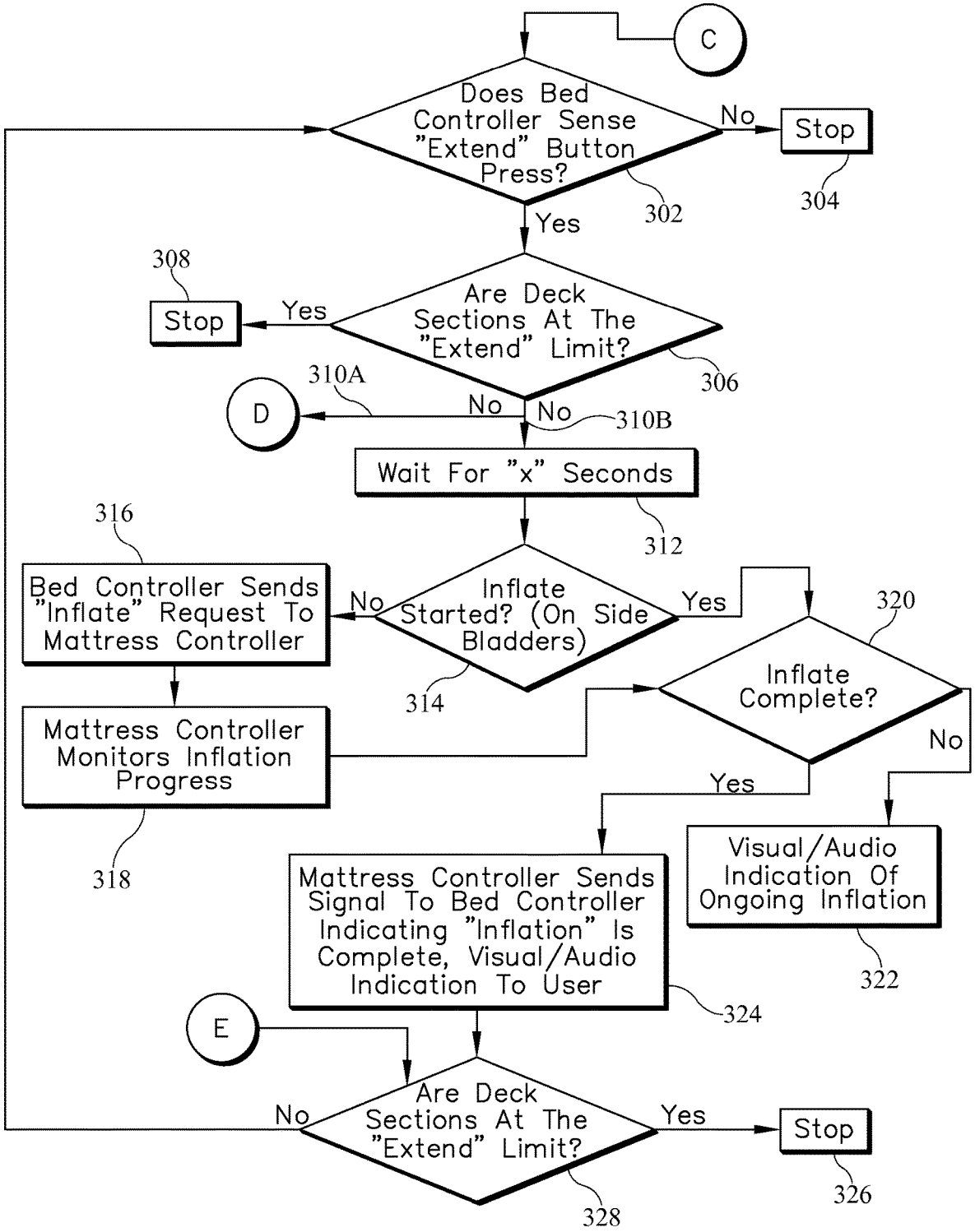
Figure 8B:
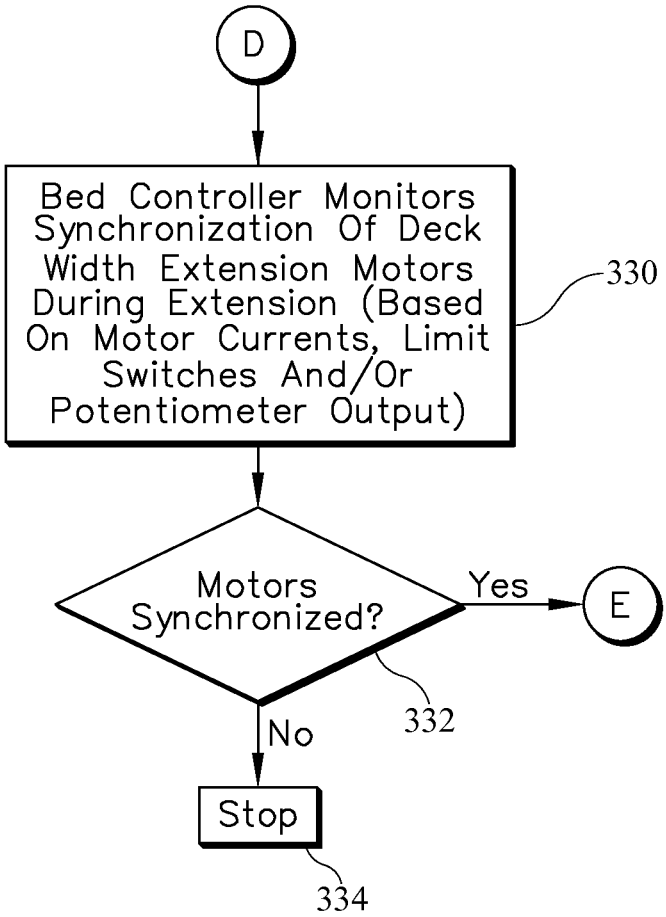
Figure 9:
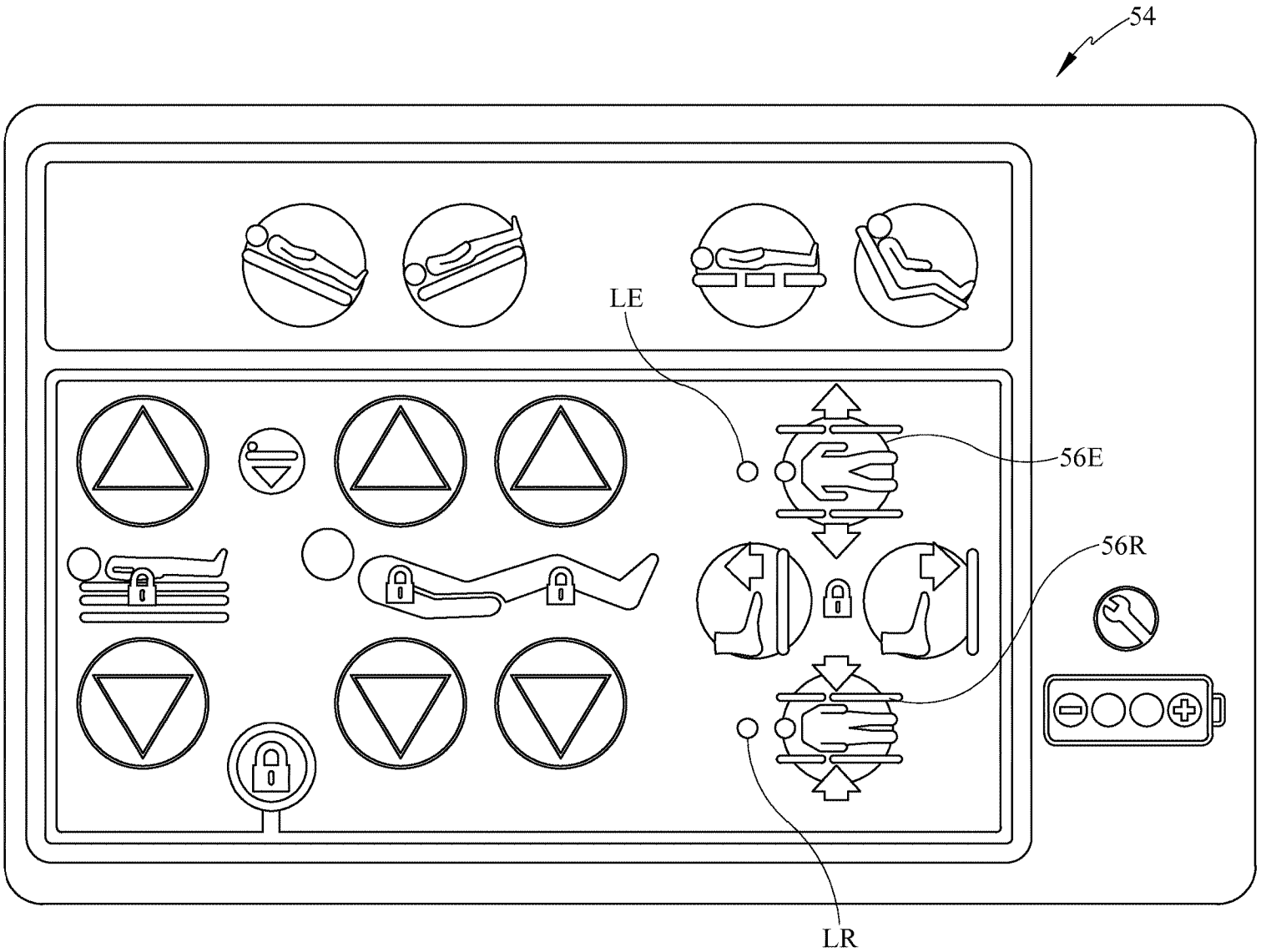
FIG. 9 is a view of a control interface having a retract button and an extend button that a user uses to reduce or expand respectively the width of the person support apparatus.

FIGS. 7 and 7B and 8 and 8B are block diagrams showing a second method of altering the width of the bed. FIG. 7B is a continuation of FIG. 7 and FIG. 8B is a continuation of FIG. 8. Therefore as a matter of convenience FIGS. 7 and 7B are referred to simply as FIG. 7 and FIGS. 8 and 8B are referred to simply as FIG. 8. The method of FIGS. 7 and 8 use a control interface 54 such as the one shown in FIG. 9 in which one button 56E is used to command extension or expansion of the bed and a separate button 56R is used to command retraction. The control interface of FIG. 9 also has indicator lights LE and LR. When the bed is fully extended light LE glows steady green and light LR is off. When the bed is fully retracted light LR glows steady green and light LE is off. When the bed is in an intermediate state (neither fully extended nor fully retracted) one of the lights glows flashing yellow.

In FIG. 7, block 202 tests whether or not the bed controller senses that retract button 56R is being pressed. If not the method proceeds to block 302 of FIG. 8 and tests whether or not the bed controller senses that extend button 56E is being pressed. However if the test at block 202 reveals that the retract button is being pressed the method proceeds to block 206. Pressing either button 56R, 56E generates a command to alter the width of the bed. The commands are of opposite polarity, i.e. one is to retract, the other is to extend.

Block 206 tests whether or not the deck extensions (e.g. extensions 36) are at their limit of retraction. If so, the method proceeds to block 208 and stops except for continuing the tests of blocks 202 and 302. If the deck extensions are not at their limit of retraction the method proceeds along paths 210A and 210B to blocks 230 and 212 respectively. First considering path 210A, at block 230 the bed controller monitors whether the deck width adjustment motors (which are operating as a result of a user continuing to press the retract button) are synchronized. If not the method proceeds to block 234 and stops the motors. If so the method branches to block 228. Now considering path 210B, at block 212 the method pauses or delays for a brief time interval (a second or two) while continuing to monitor whether or not the retract button is still being pressed. If the user has continued to apply pressure to the retract button throughout the pause interval, the method proceeds to block 214. However if user pressure on the retract button is discontinued during the pause interval the method does not proceed to block 214. The pause interval enables the method to distinguish between a genuine user command and a brief inadvertant touch of the retract button.

Block 214 tests whether or not deflation of the side bladders 52 has begun. If not the bed controller issues a "deflate" command to the mattress controller at block 216. The mattress controller responds by beginning deflation of the side bladders. At block 218 the mattress controller monitors deflation progress and proceeds to block 220. At block 220 the method tests whether or not deflation is complete either as a result of the actions at blocks 216 and 218 or as a result of having arrived directly at block 220 from block 214. If the test at block 220 reveals that deflation is not complete the method continues the deflation process and sends a visual and/or aural indication of the ongoing deflation. One example of a visual indication is the flashing yellow illumination of one of lights LE and LR as described above. If the test at block 220 reveals that deflation is complete the method proceeds to block 224 where the mattress controller signals the bed controller that deflation is complete and sends a visual and/or aural indication of the fact that deflation is complete. One example of a visual indication is the steady green illumination of light LR as described above.

Irrespective of whether the method has followed path 210A through blocks 230 and 232 or has followed path 210B through the appropriate blocks beyond block 212, the method arrives at block 228 where it tests whether or not the deck sections are at their limit of retraction. If not, the method returns to block 202. If so, the method proceeds to block 226 and stops, except for continuing to monitor for whether or not the extend and retract buttons are being pressed.

The portion of the method outlined in FIG. 8 is similar to the portion of the method disclosed in FIG. 7 but shows how the method responds to user pressure applied to the extend button 56E. In FIG. 8, block 302 tests whether or not the bed controller senses that extend button 56E is being pressed. If not the method proceeds to block 304 and stops, although the test of block 302 (and of block 202 in FIG. 7) continues to be made. However if the test at block 302 reveals that the retract button is being pressed the method proceeds to block 306.

Block 306 tests whether or not the deck extensions (e.g. extensions 36) are at their limit of extension. If so, the method proceeds to block 308 and stops except for continuing the tests of blocks 202 and 302. If the deck extensions are not at their limit of retraction the method proceeds along paths 310A and 310B to blocks 330 and 312 respectively. First considering path 310A, at block 330 the bed controller monitors whether the deck width adjustment motors (which are operating as a result of a user continuing to press the extend button) are synchronized. If not the method proceeds to block 334 and stops the motors. If so the method branches to block 328. Now considering path 310B, at block 312 the method pauses or delays for a brief time interval (a second or two) while continuing to monitor whether or not the extend button is still being pressed. If the user has continued to apply pressure to the extend button throughout the pause interval, the method proceeds to block 314. However if user pressure on the extend button is discontinued during the pause interval the method does not proceed to block 314. The pause interval enables the method to distinguish between a genuine user command and a brief inadvertant touch of the retract button.

Block 314 tests whether or not inflation of the side bladders 52 has begun. If not the bed controller issues a "inflate" command to the mattress controller at block 316. The mattress controller responds by beginning inflation of the side bladders. At block 318 the mattress controller monitors inflation progress and proceeds to block 320. At block 320 the method tests whether or not inflation is complete either as a result of the actions at blocks 316 and 318 or as a result of having arrived directly at block 320 from block 314. If the test at block 320 reveals that inflation is not complete the method continues the inflation process and sends a visual and/or aural indication of the ongoing inflation. One example of a visual indication is the flashing yellow illumination of one of lights LE and LR as described above. If the test at block 320 reveals that inflation is complete the method proceeds to block 324 where the mattress controller signals the bed controller that inflation is complete and sends a visual and/or aural indication of the fact that inflation is complete. One example of a visual indication is the steady green illumination of light LR as described above.

Irrespective of whether the method has followed path 310A through blocks 330 and 332 or has followed path 310B through the appropriate blocks beyond block 312, the method arrives at block 328 where it tests whether or not the deck sections are at their limit of extension. If not, the method returns to block 302. If so, the method proceeds to block 326 and stops, except for continuing to monitor for whether or not the extend and retract buttons are being pressed.

As previously noted the deck extensions can be extended and retracted manually. In the case of manual operation the step of determining whether or not the extend or retract buttons are pressed (blocks 202 and 302) will not yield a "yes" answer. However the bed controller is still able to monitor current readings or potentiometer signals to track the position of the deck extension, including whether or not the deck extension is at its extend limit or retract limit. As a result the method for manual operation is the same except that instead of being initiated by the bed controller sensing whether or not the retract or extend button is being pressed (blocks 202, 302) it is initiated by changes in the current readings or potentiometer signals. Similar to the case of push-button operation, manual operation generates a width alteration command. If a user pushes on the deck extender (or a component attached to the extender) to cause the deck extender to retract, the command is a retract command. If a user pulls on the deck extender (or a component attached to the extender) to cause the deck extender to extend, the command is an extend command. The retract and extend commands are of opposite polarity.

The foregoing description and associated FIGS. 7 and 8 address retraction and extension explicitly. More generally the method monitors for a command to alter the width of the deck and determines the polarity of the command (blocks 202, 302). The method ensures that the width extender is not at a limit inconsistent with the polarity of the command (blocks 206, 306), operates an actuator to move the width extender in a direction consistent with the polarity of the command (implicit in blocks 230, 330) and issues a fluid supply control signal (not explicitly shown, but a consequence of blocks 216, 316) to operate the fluid supply device in a manner consistent with the polarity of the command. The fluid supply control signal is issued in response to a mattress control signal (output of blocks 216, 316). The mattress control signal is generated in response to the command.

The method monitors response of the mattress to operation of the fluid supply device at blocks 218, 318. The method of curtails operation of the actuator in response to the extender reaching a limit consistent with the polarity of the command at blocks 208, 308. The issuing step is conditioned on continued presence of the command during a pause interval (blocks 212, 312). The method also includes the step of providing an indication distinguishing between completion and incompletion of width adjustment (blocks 222, 322).

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description.

The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The disclosures of any references and publications cited above are expressly incorporated by reference in their entireties to the same extent as if each were incorporated by reference individually.

We claim:

1. A system for changing width of a person support apparatus, comprising:

a bed controller operable to generate a width alteration command in response to activation of a button and operable to generate the width alteration command in response to manual adjustment of a width of a deck section of the person support apparatus;

a motor configured to be controlled by said bed controller, said motor configured to alter the width of at least a portion of the deck section of said person support apparatus in response to the width alteration command generated by activation of the button;

a sensor operable to determine the width of the at least a portion of a deck section;

a mattress controller configured to communicate with said bed controller;

a fluid supply device configured to be controlled by said mattress controller;

a mattress configured to be supported by said person support apparatus, said mattress comprising at least one width extension chamber fluidly connected to said fluid supply device and configured to be inflated or deflated by said fluid supply device upon said fluid supply device receiving a fluid supply control signal from said mattress controller and forming a width extension surface for addition to a main surface of the mattress for supporting a person; and a transducer configured to communicate a transducer signal indicative of pressure inside said at least one width extension chamber to said mattress controller;

wherein when the motor alters the width of the at least a portion of the deck section of said person support apparatus to an extended position in response to the width alteration command, the mattress controller communicates with said fluid supply device to inflate the at least one width extension chamber to a predetermined pressure threshold based at least in part on the weight of the person;

wherein the bed controller monitors the sensor to determine if the width of the at least a portion of a deck section has been manually adjusted without operation of the motor and, if the width has been adjusted without operation of the motor, generates the width alteration command; and wherein the mattress controller is operable to change pressure in the at least one width extension bladder based on the width alteration command generated by the manual adjustment of the at least a portion of a deck section.

2. The system of claim 1 wherein said motor is configured to actuate at least one of an upper body deck extension, a seat deck section extension, a thigh deck section extension and a foot deck section extension.

3. The system of claim 1 wherein said bed controller further comprises a bed controller processor.

4. The system of claim 3 wherein said mattress controller further comprises a mattress controller processor configured to communicate with said bed controller processor.

5. The system of claim 1 wherein said bed controller sends a motor control signal to stop actuation of at least one of an upper body deck extension, a seat deck section extension, a thigh deck section extension and a foot deck section extension to said motor based on the signal received from said transducer.

6. The system of claim 1 wherein the mattress controller issues the fluid supply control signal to the fluid supply device in response to the mattress controller receiving a mattress control signal from the bed controller.

7. The system of claim 1 including a control interface comprising the at least one button for commanding width alteration of said person support apparatus and wherein the bed controller is configured to communicate with the control interface and the width alteration command signal is generated in response to selection of the button.

8. The system of claim 7 wherein the at least one button for commanding width alteration is an extend button for commanding expanded width and a retract button for commanding reduced width.

9. A system for changing width of a person support apparatus, comprising:

a bed controller configured to receive a command signal indicative of a command for width alteration, wherein the command for width alteration is generate in response to activation of a button and the command for width alteration is generated in response to manual adjustment of a width of a deck section of the person support apparatus;

a motor configured to be controlled by said bed controller, said motor configured to alter the width of at least a portion of the deck section of said person support apparatus in response to the width alteration command;

a sensor operable to determine the width of the at least a portion of a deck section;

a mattress controller configured to communicate with said bed controller;

a fluid supply device configured to be controlled by said mattress controller;

a mattress configured to be supported by said person support apparatus, said mattress comprising at least one width extension chamber fluidly connected to said fluid supply device and configured to be inflated by said fluid supply device upon said fluid supply device receiving a fluid supply control signal from said mattress controller and forming a width extension surface for addition to a main surface of the mattress for supporting a person; and a transducer configured to communicate a transducer signal indicative of pressure inside said at least one width extension chamber to said mattress controller, wherein, responsive to a user request for deflation, the mattress controller is configured to determine, based on the pressure as determined by the transducer signal, whether the at least one width extension bladder is arranged in one of (i) a deflated state in which the width extension surface is unavailable for addition to the main surface, and (ii) an incompletely deflated state, and wherein the mattress controller is configured to communicate an incompletely deflated signal with the bed controller responsive to determination that the at least one width extension bladder is in the incompletely deflated state, and to communicate a deflation complete signal with the bed controller in response to determination by the mattress controller that the at least one width extension bladder is arranged in the deflated state, and to communicate an inflation complete signal to the bed controller in response to determination by the mattress controller that the at least one width extension bladder is arranged in the inflated state;

wherein the bed controller is configured to operate the motor to alter the width of the at least a portion of the deck section of said person support apparatus to an extended position, and to communicate with the mattress controller to operate said fluid supply device to inflate the at least one width extension chamber to a predetermined pressure threshold based at least in part on the weight of the person;

wherein the bed controller monitors the sensor to determine if the width of the at least a portion of a deck section has been manually adjusted without operation of the motor and, if the width has been adjusted without operation of the motor, generates the command for width adjustment; and wherein the mattress controller is operable to change pressure in the at least one width extension bladder based on the command for width adjustment generated by the manual adjustment of the at least a portion of a deck section.

10. The system of claim 1, wherein the mattress controller to determines whether the at least one width extension bladder is arranged in a deflated state in which the width extension surface is unavailable for addition to the main surface by determining that the at least one width extension bladder is incompletely deflated and responsively communicating an incomplete deflation signal with the bed controller.

11. The system of claim 1, wherein the bed controller does not initiate alteration of the width of at least a portion of a deck section of said person support apparatus until the width extension bladder is fully deflated.

12. The system of claim 9, wherein configuration of the mattress controller to determine whether the at least one width extension bladder is arranged in a deflated state in which the width extension surface is unavailable for addition to the main surface, includes determining that the at least one width extension bladder is incompletely deflated and responsively communicating an incomplete deflation signal with the bed controller.

13. The system of claim 9 wherein said motor is configured to actuate at least one of an upper body deck extension, a seat deck section extension, a thigh deck section extension and a foot deck section extension.

14. The system of claim 9 wherein said bed controller further comprises a bed controller processor.

15. The system of claim 14 wherein said mattress controller further comprises a mattress controller processor configured to communicate with said bed controller processor.

16. The system of claim 9 wherein said bed controller sends a motor control signal to stop actuation of at least one of an upper body deck extension, a seat deck section extension, a thigh deck section extension and a foot deck section extension to said motor based on the signal received from said transducer.

17. The system of claim 9 wherein the mattress controller issues the fluid supply control signal to the fluid supply device in response to the mattress controller receiving a mattress control signal from the bed controller.

18. The system of claim 9 including a control interface comprising the at least one button for commanding width alteration of said person support apparatus and wherein the bed controller is configured to communicate with the control interface and the width alteration command signal is generated in response to selection of the button.

19. The system of claim 17 wherein the at least one button for commanding width alteration is an extend button for commanding expanded width and a retract button for commanding reduced width.

* * * * *